US011060833B2

(12) United States Patent
Nzengung

(10) Patent No.: US 11,060,833 B2
(45) Date of Patent: Jul. 13, 2021

(54) MUNITIONS AND ORDNANCE REMEDIATION BLANKET (MORB)

(71) Applicant: Valentine Asongu Nzengung, Duluth, GA (US)

(72) Inventor: Valentine Asongu Nzengung, Duluth, GA (US)

(73) Assignee: MuniRem Environmental, LLC, Duluth, GA (US)

( * ) Notice: Subject to any disclaimer, the term of this patent is extended or adjusted under 35 U.S.C. 154(b) by 839 days.

(21) Appl. No.: 15/399,555

(22) Filed: Jan. 5, 2017

(65) Prior Publication Data

US 2018/0112963 A1 Apr. 26, 2018

Related U.S. Application Data

(60) Provisional application No. 62/275,474, filed on Jan. 6, 2016.

(51) Int. Cl.
*F42D 5/05* (2006.01)

(52) U.S. Cl.
CPC ..... *F42D 5/05* (2013.01)

(58) Field of Classification Search
CPC ... F42D 5/05; A62D 2101/06; A62D 2101/00; A62D 2101/26; A62D 2101/02
USPC ..... 588/6
See application file for complete search history.

(56) References Cited

U.S. PATENT DOCUMENTS

| | | | | |
|---|---|---|---|---|
| 2011/0124945 | A1* | 5/2011 | Smylie | A62D 3/35 588/317 |
| 2014/0206922 | A1* | 7/2014 | Nzengung | A62D 3/36 588/318 |
| 2016/0040962 | A1* | 2/2016 | Rossow | B32B 5/06 89/36.02 |

* cited by examiner

*Primary Examiner* — Edward M Johnson
(74) *Attorney, Agent, or Firm* — White-Welker & Welker, LLC; Matthew T. Welker, Esq.

(57) ABSTRACT

A device and method for the destruction of commercial explosives, improvised explosive devices (IED) and military grade weapons, particularly weapons with fragmentary and shrapnel ejection during detonation. The device is a multi-layer blanket with an impermeable first outer layer made of plastic or similar fiber. A blasting mat is located adjacent to the impermeable outermost layer for the containment of fragmentary and shrapnel ejection, should a detonation occur. One or more neutralization reagents are located between the blasting mat layer and a second, water-soluble seal, acting as an opposing outer layer. The versatile neutralization reagent(s) are released and rapidly react with the explosive fillers of breached munitions and similar devices when the water-soluble seal contacts water, while the outermost plastic layer isolates the neutralization reagents against the explosive item during the neutralization process and the blast mat provides protection in the event of an unexpected detonation.

16 Claims, 6 Drawing Sheets

MUNITIONS AND ORDNANCE REMEDIATION BLANKET (MORB)

CROSS REFERENCE TO RELATED APPLICATIONS

This application claims priority from U.S. Patent Application Ser. No. 62/275,474, entitled "Munitions and Ordnance Remediation Blanket (MORB) and Methods of Using Same", filed on 6 Jan. 2016. The benefit under 35 USC § 119(e) of the United States provisional application is hereby claimed, and the aforementioned application is hereby incorporated herein by reference.

SEQUENCE LISTING OR PROGRAM

Not Applicable

TECHNICAL FIELD OF THE INVENTION

The present invention relates generally to inerting, neutralization, or the destruction of military grade weapons and improvised explosive devices. More specifically, the present invention relates to a method and device for the destruction of commercial explosives, improvised explosive devises (IED) and military grade weapons, particularly weapons with fragmentary and shrapnel ejection during detonation.

BACKGROUND OF THE INVENTION

Militaries and governments around the world have amassed and abandoned vast new and used arsenals of weapons grade munitions, such as mortars, grenades, and the like. Many of these weapons were designed to disperse deadly shrapnel at high velocities upon detonation. This shrapnel dispersion can be achieved using numerous different methods, such as the munition casing itself being fragmented upon detonation, self-contained shrapnel pieces dispersed upon detonation, or many other methods. Upon detonation, this shrapnel is designed to be ejected at tremendous velocities and sometimes extremely high temperatures for the purpose of piercing and destroying armor, personnel, or anything else within the immediate vicinity.

However, as is inherent with any type of munition, shrapnel dispersing munitions have a fixed life span, thus becoming extremely unstable and unreliable past their design life. As such, and combined with the worldwide current demilitarization of fragmentary and shrapnel munitions, there is a need for an effective, safe, and efficient manner to dispose of surplus and aged weaponry.

Presently, the main method of destruction of these weapons is to simply detonate them in a controlled environment. The majority of times this controlled environment is nothing more than a deserted location. However, there are many munitions that are located under water that must be disposed of in a safe and environmentally friendly manner.

A common method of destruction is manual dismantling of the munition itself. As can be expected, this process is extremely dangerous for the personnel performing this function. The munition must be carefully disassembled, defused, and correctly disposed of. As such, this method has several limitations relating to the dangerous nature of dismantling the munition devices and properly disposing of the remaining products. The present invention overcomes this limitation by, for example, negating the need of dismantling the munition prior to destruction.

SUMMARY OF THE INVENTION

The components of a Munitions and Ordnance Remediation Blanket (MORB) includes: an impermeable outer layer made of plastic or similar fiber; a Commercial blasting mat layer; a MUNIREM reagent in powder or solution layering acting as an instant explosives neutralization reagent; and a commercial water soluble seal on the opposing outer layer.

The MORB taught by the present invention builds on explosion hazard mitigation (safety) provided by the blasting mat and slow release of the reagent provided by the encapsulation of the MUNIREM reagents in slow release tablets or the MUNIREM coated with a slow decay polymer.

The present invention also teaches several methods of use for the MORB device depending on the location and condition of the ordnance being remediated.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DEFINITIONS

An improvised explosive device (IED) is a bomb constructed and deployed in ways other than in conventional military action. It may be constructed of conventional military explosives, such as an artillery round, attached to a detonating mechanism IEDs are commonly used as roadside bombs.

Munitions and Ordnance Remediation Blanket (MORB) is the device taught by the present invention for the safe and environmentally friendly breaching and neutralization of the energetics fillers in UXOs on land and especially munitions found at underwater sites.

Unexploded ordnance (UXO) are explosive weapons (bombs, bullets, shells, grenades, land mines, naval mines, bulk explosive and energetics, etc.) that did not explode when they were employed and still pose a risk of detonation, potentially many decades after they were used or discarded.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Now referring to the Figures, the device is a Munitions and Ordnance Remediation Blanket (MORB) as taught and used by the present invention are shown. The present invention discloses the design for safe and environmentally friendly breaching and neutralization of the energetics fillers in UXOs on land and especially munitions found at underwater sites (underwater UXOs). The design mirrors a blanket consisting of multiple layers, each with a separate function.

Figure 1:
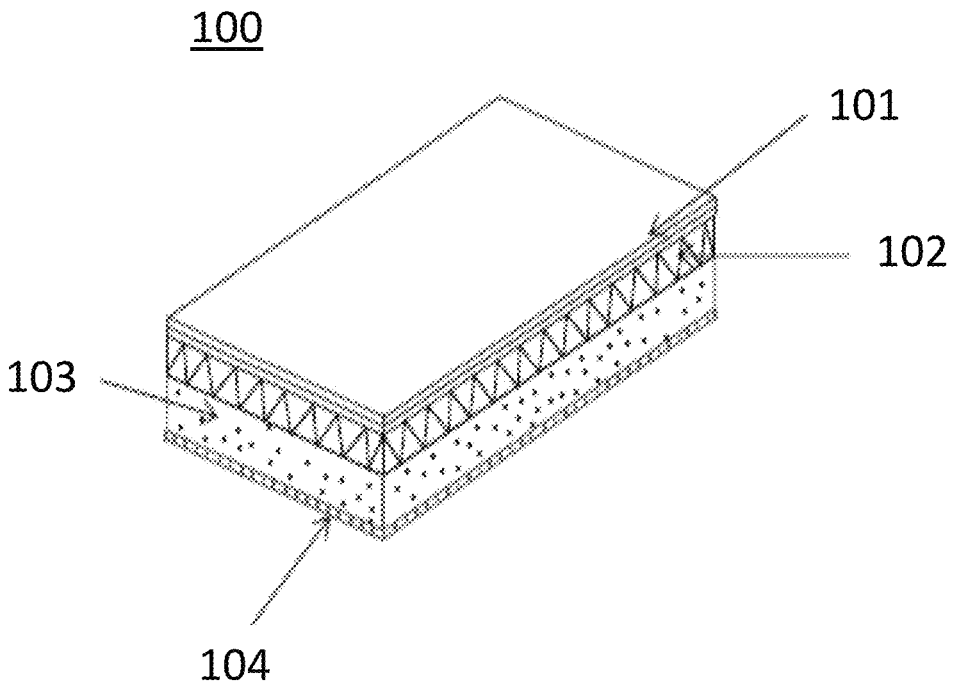
FIG. 1 is an illustration of the components of a Munitions and Ordnance Remediation Blanket (MORB) as taught by the present invention.

Now referring to FIG. 1, the components of a Munitions and Ordnance Remediation Blanket (MORB) 100 includes: an impermeable outer membrane layer 101 made of plastic or similar fiber; a commercial blasting mat layer 102; a neutralization reagent layer 103, in one embodiment MUNIREM, in powder or solution forms is used—acting as an instant explosives neutralization reagent; one or more other abiotic munitions neutralization reagents, e.g., black carbon plus sulfide, metal reductants (zero valent iron). Etc.; and a commercial water-soluble seal or cover 104 (e.g., PVA water-soluble bags for both powders and solids and similar water-soluble packaging).

In one embodiment, MAZZELLA patented wire rope blasting mats are used as the blasting mat layer 102. In an alternative embodiment, the blasting mat is a polymer membrane is the blasting mat layer 102.

The MORB taught by the present invention builds on explosion hazard mitigation (safety) provided by the blasting mat and slow release of the reagent provided by the encapsulation of the MUNIREM reagents in slow release tablets or the MUNIREM coated with a slow decay polymer.

MUNIREM is a mature and award winning technology utilizing reduction chemistry to: instantly neutralize and degrade explosives and chemical warfare materials (CWM), while also stabilizing metals as the insoluble metal sulfides. MUNIREM is a solution for a broad range of explosives and munitions constituents including Mustard (CWM), HMX, RDX, TNT, TNR, DNTs, ADNTs, NBs, NDMA, Black Powder, Lead Styphnate, Nitrocellulose, Nitroguanidine, PETN, PBX and reactive Aluminum. The very short cleanup time and closeout associated with this technology eliminates the O&M costs (30-50% savings) associated with other remediation technologies.

MUNIREM applications have supported demilitarization and remediation projects at United States Department of Defense installations, Canada, Australia, Taiwan and private industry sites.

MUNIREM formulations and applications are tailored to each site to ensure optimum performance and desired results. It can be applied as a solid or aqueous solution to achieve optimal and desirable results.

Contaminated soils treatment involves mixing MUNIREM powder into the soils and adding water to achieve in-situ or ex-situ remediation.

Groundwater remediation involves injection of the MUNIREM solution into the site groundwater to instantly degrade the dissolved contaminants and create permeable reactive aquifer solids for long-term treatment of the plume.

Decontamination applications involve spraying the MUNIREM solution on building walls, large equipment and scrap metals (including bombs shells, bomb components, projectiles); and soaking small sized equipment in MUNIREM baths.

Alternative to Open Burn/Open Detonation involves application of MUNIREM in solution or powder form to neutralize bulk explosives and destroy residual explosives in different materials.

The different formulations for MUNIREM are: MuniRem-R811E, MuniRem-R541E, MuniRem-FE, and MuniRem-Gel.

MUNIREM has been demonstrated and validated at US Department of Defense installations to: Neutralize recovered bomb contents and decontaminate bomb casings; Rapidly treat high concentrations of TNT, RDX and HMX in soils; Degrade explosives in water including pink water to non-detect concentrations; Degrade explosives in spent activated carbon (GAC) from pink water treatment; Neutralize highly reactive open burn open detonation (OBOD) ash; Treat bag house waste which passed TCLP test; Destroy high explosives and stabilize metals in demilitarization sludge; Neutralize solid propellants of different particle sizes; Degrade sulfur mustard to ethylene gas (the same gas from degradation of chlorinated solvents by zero valent iron and anaerobic bacteria); Decontaminate walls in explosives handling and processing buildings using a spray of liquid MUNIREM reagent; and Decontaminate demilitarization/militarization equipment.

Figure 2:
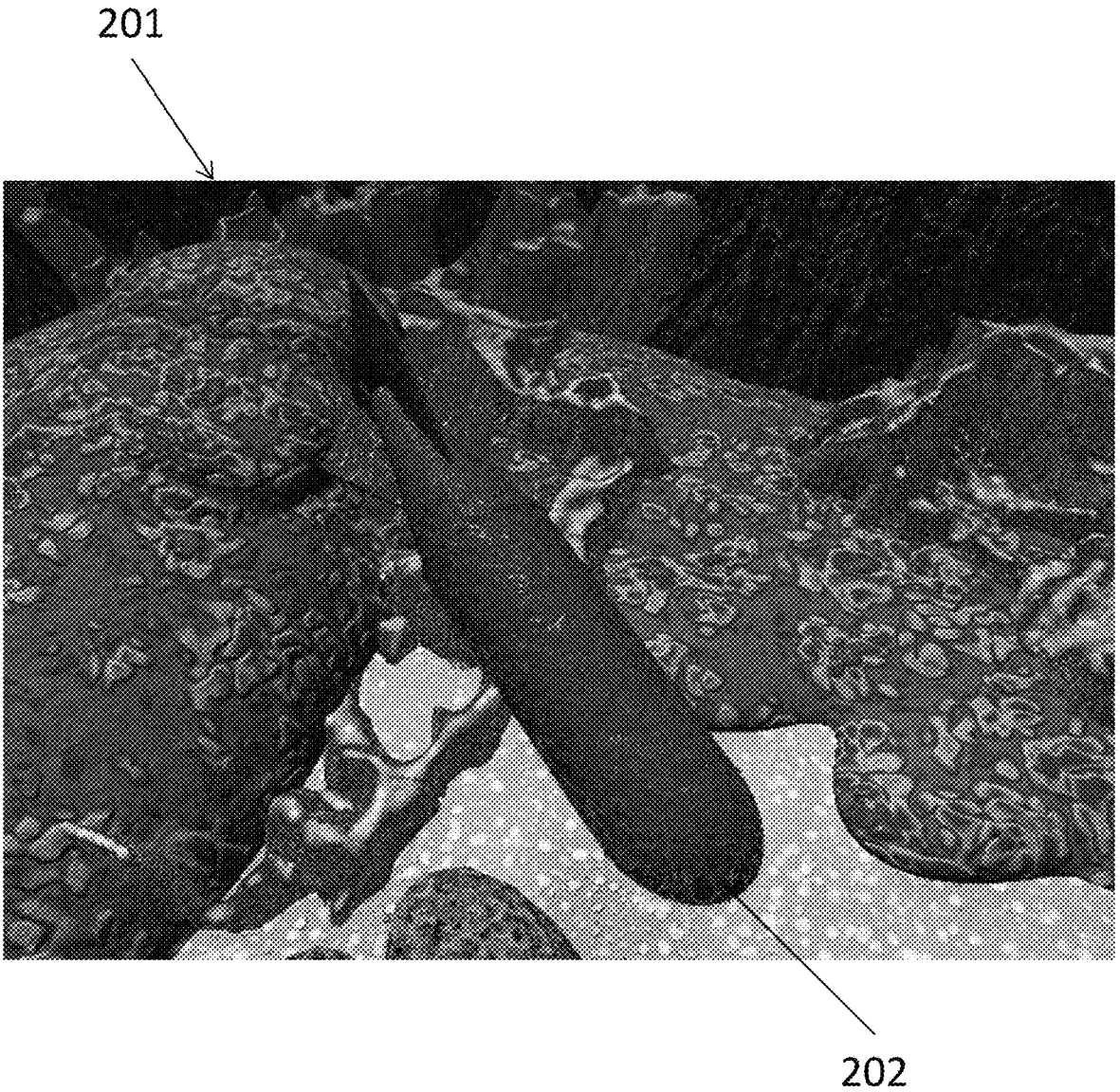
FIG. 2 is a schematic of a typical underwater munition.
Figure 3:
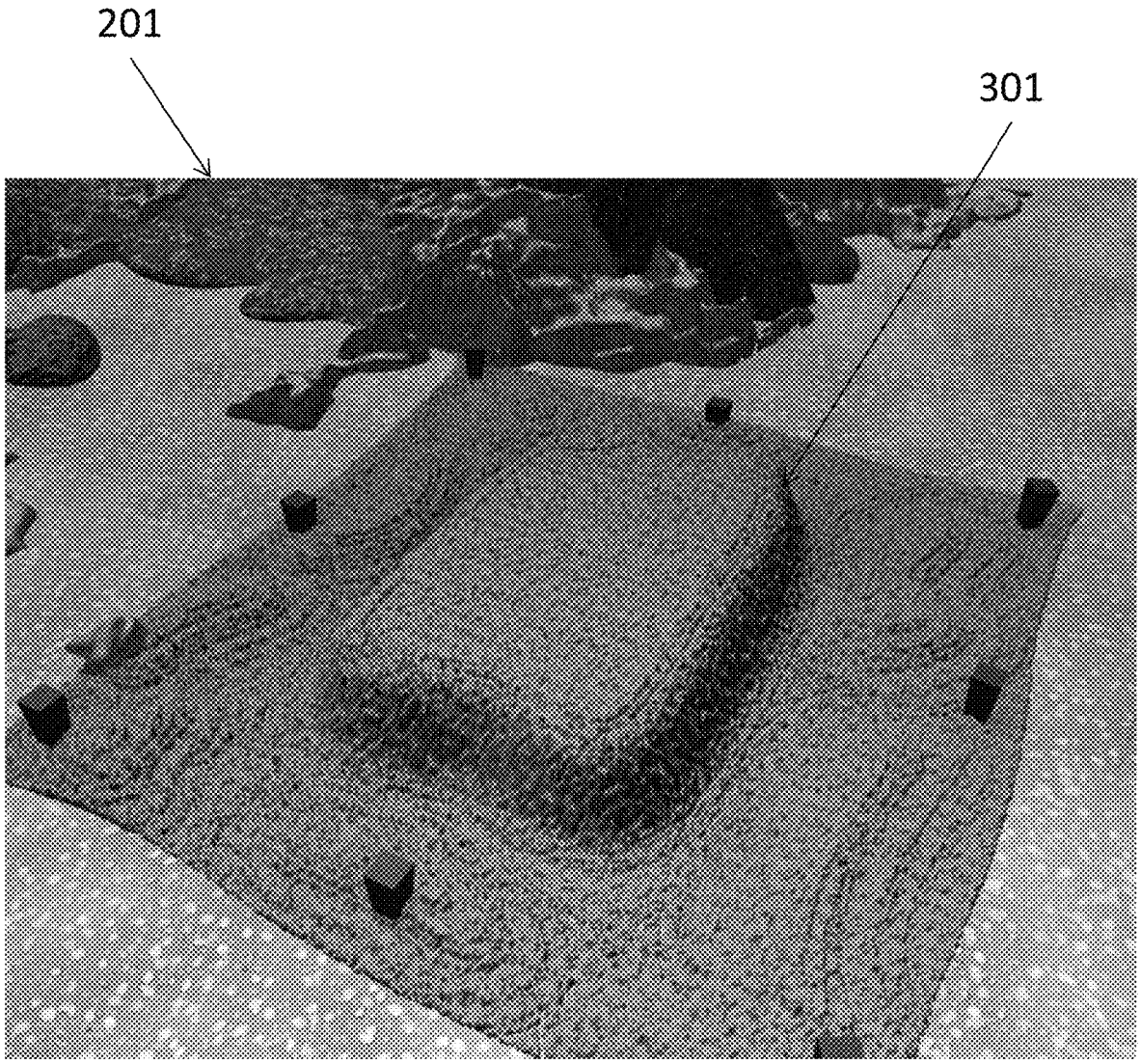
FIG. 3. is a schematic of a Munitions and Ordnance Remediation Blanket (MORB) as taught by the present invention in a deployed situation.

As shown in FIGS. 2-3, the Munitions and Ordnance Remediation Blanket 301 (MORB) of the present invention can be used in-situ and on-site remediation of UXOs, decaying munitions 202, and energetic point sources at underwater munition and terrestrial sites 201 as an alternative to open detonation/open burning. It is a green alternative for explosives destruction providing the safe neutralization of energetics and counters IED technology.

Figure 4:
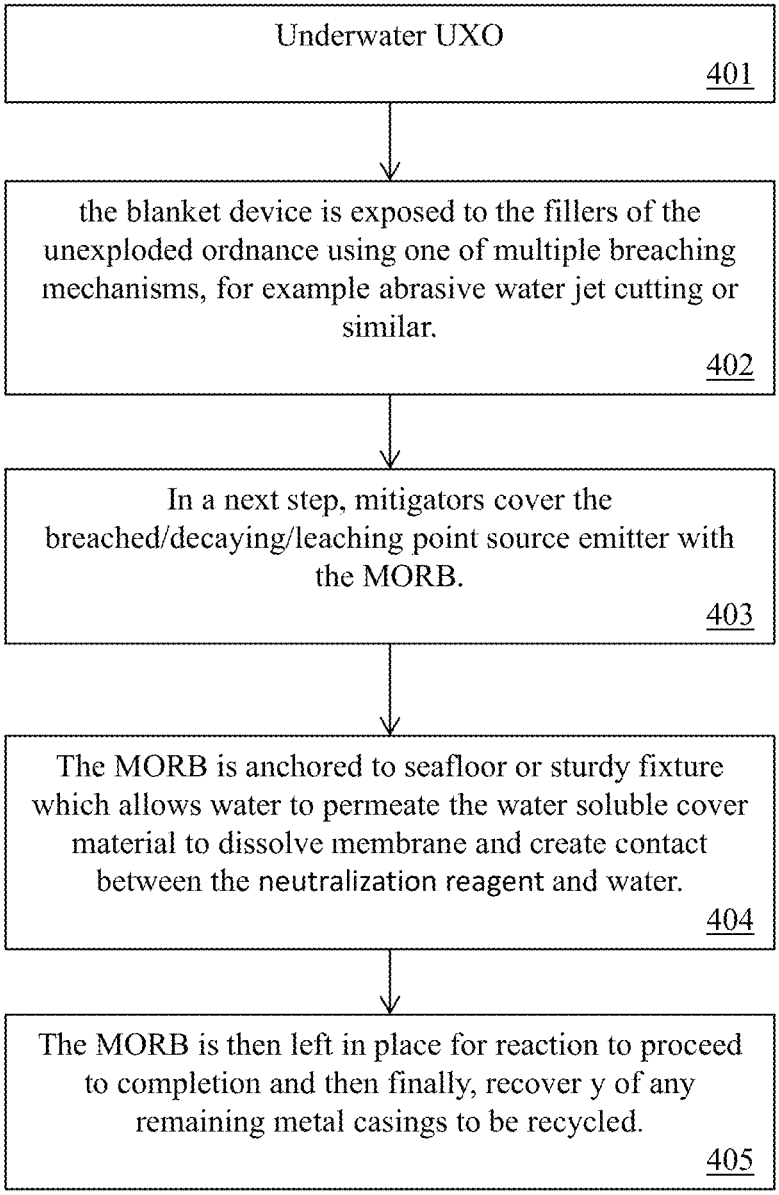
FIG. 4 is a flow chart illustrating one method for using the MORB on an underwater ordnance as taught by the present invention.
Figure 5:
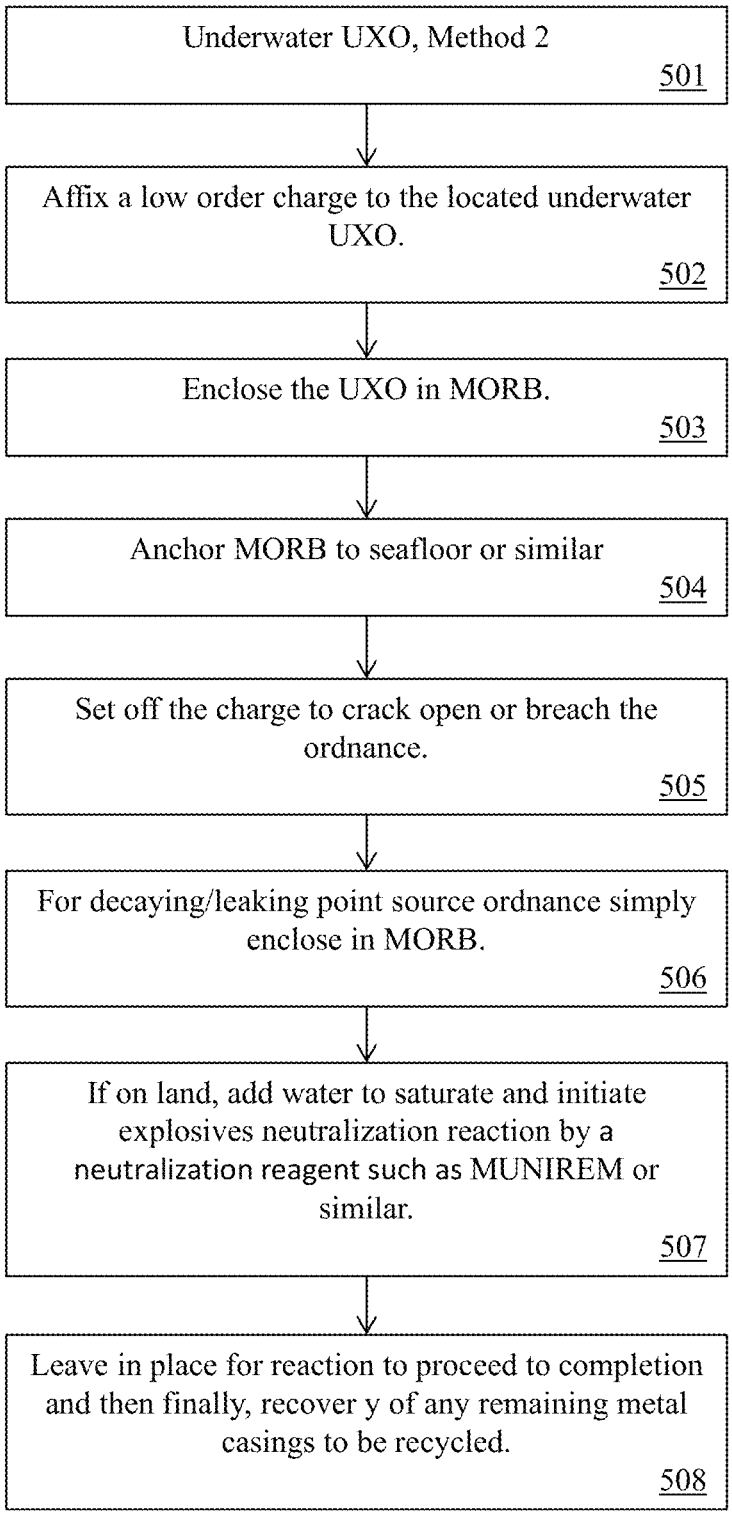
FIG. 5 is a flow chart illustrating one method for using the MORB on an underwater ordnance as taught by the present invention.

Referring to FIG. 4, in a first method directed to Underwater UXO 401, the blanket device is exposed to the unexploded ordnance using one of multiple breaching mechanisms, for example abrasive water jet cutting or similar 402. In a next step, mitigators cover the breached/decaying/leaching point source emitter with the MORB 403. The MORB is anchored to seafloor or uses a sturdy fixture, which allows water to permeate the water-soluble cover material to dissolve membrane and create contact between the energetics, MUNIREM and Water 404. The MORB is then left in place for the reaction to proceed to completion and then finally, allow the recovery of any remaining metal casings to be recycled 405.

In a second method of application of the MORB in an underwater UXO application 501, first a low order charge is attached to the located underwater UXO 502. Next, the UXO is enclosed in a MORB 503. The MORB is anchored to the seafloor or similar 504. The charge is set off to crack open or breach the ordnance 505. For decaying/leaking point source ordnance simply enclose in MORB 506. If on land, add water to saturate and initiate explosives neutralization reaction by a neutralization reagent such as MUNIREM or similar 507. Next, leave in place for the reaction to proceed and then finally, recover y of any remaining metal casings to be recycled 508.

Other forms of breaching the ordnance, such as drilling, waterjet cutting, and cryogenic fracturing may be used in the method. Affixing and detonating a charge is used in an exemplary manner and any of the other forms may be substituted based on feasibility and best practices in the industry.

Figure 6:
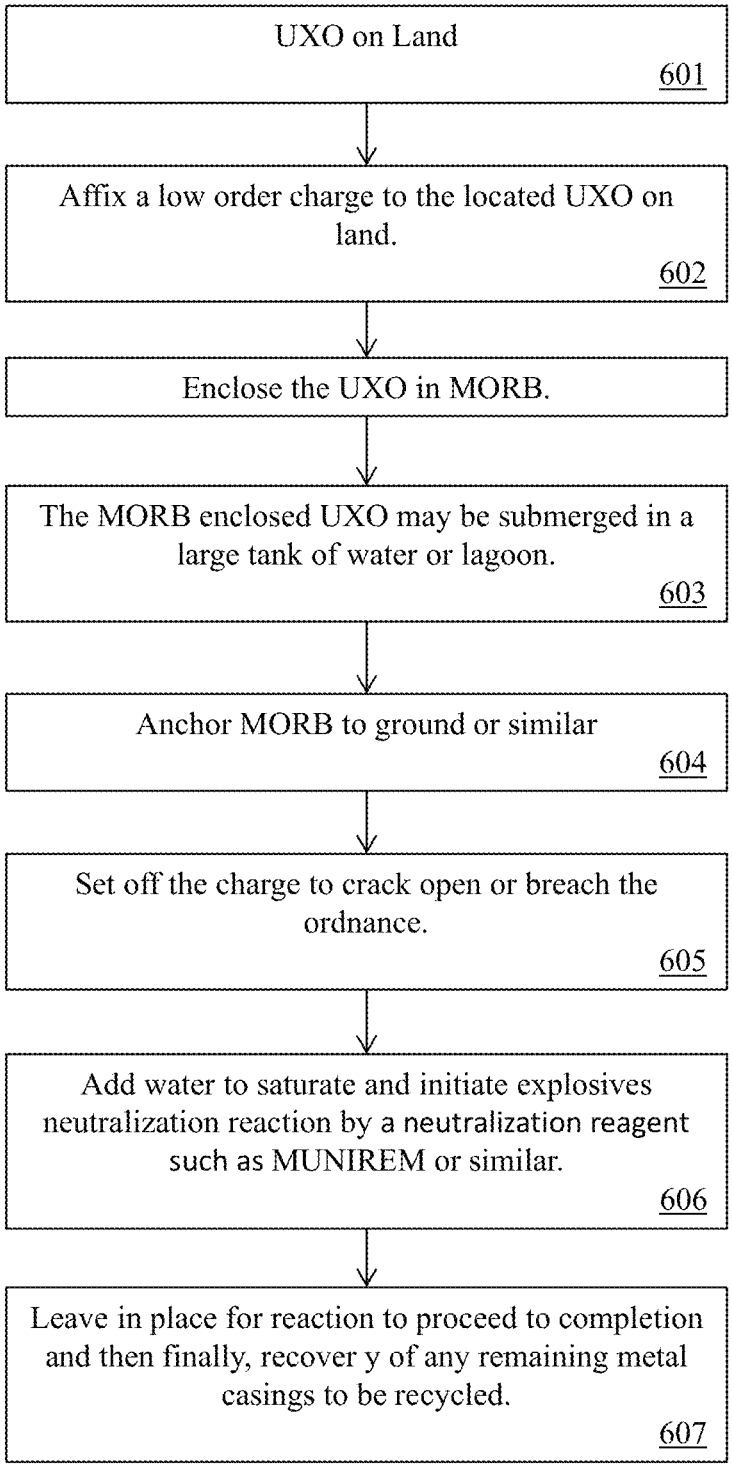
FIG. 6 is a flow chart illustrating one method for using the MORB on a land-based ordnance as taught by the present invention.

Now referring to FIG. 6, in an application for an UXO on Land 601, first affix a low order charge to the located UXO on land 602. Next, enclose the UXO in MORB 603. The MORB enclosed UXO may be submerged in a large tank of water or lagoon 603. Anchor MORB to ground or similar 604. Set off the charge to crack open or breach the ordnance 605. Add water to saturate and initiate explosives neutralization reaction by a neutralization reagent such as MUNIREM or similar 606. Leave in place for reaction to proceed to completion and finally, recover metal casing and recycle 607.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The invention claimed is:

1. A Munitions and Ordnance Remediation Blanket (MORB) device comprising:

a remediation blanket having a two-layer outer surface;

an impermeable first outer membrane layer made of plastic or similar fiber; and a water-soluble seal acting as the second, opposing outer layer;

a safety blasting mat layer, internally located adjacent to the impermeable first outer layer; and one or more neutralization reagents internally located between the blasting mat layer and the second, opposing outer water-soluble seal layer.

2. The MORB device of claim 1, wherein the blasting mat is a wire rope blasting mat.

3. The MORB device of claim 1, wherein the blasting mat is a polymer membrane.

4. The MORB device of claim 1, wherein the second, opposing outer layer is constructed from water-soluble packaging.

5. The MORB device of claim 4, wherein the second, opposing outer layer is constructed from PVA water-soluble bags.

6. The MORB device of claim 1, wherein the one or more neutralization reagents are in powder or solution form.

7. The MORB device of claim 6, wherein the second, opposing outer layer is constructed from water-soluble packaging.

8. The MORB device of claim 7, wherein the second, opposing outer layer is constructed from PVA water-soluble bags.

9. The MORB device of claim 1, wherein the neutralization reagent provides instant explosives neutralization.

10. The MORB device of claim 1, wherein the neutralization reagent is in slow release tablet form.

11. The MORB device of claim 1, wherein the neutralization reagent is coated with a slow decay polymer.

12. The MORB device of claim 1, wherein the neutralization reagent comprises hydrosulfite and other constituents including black carbon, metal carbonates, and hydroxides.

13. The MORB device of claim 12, wherein the neutralization reagent is in slow release tablet form.

14. The MORB device of claim 12, wherein the neutralization reagent is coated with a slow decay polymer.

15. The MORB device of claim 1, wherein one or more other abiotic munitions neutralization reagents are combined in the reagent layer.

16. The MORB device of claim 15, wherein the neutralization reagents include black carbon plus sulfide, metal reductants, and zero valent iron.

* * * * *